US007997761B2

(12) United States Patent
Peck et al.

(10) Patent No.: US 7,997,761 B2
(45) Date of Patent: Aug. 16, 2011

(54) LED BASED HAZARDOUS LOCATION LIGHT WITH VERSATILE MOUNTING CONFIGURATIONS

(75) Inventors: John Patrick Peck, Manasquan, NJ (US); Kevin A. Hebborn, Toms River, NJ (US); Kenneth J. Zimmer, Freehold, NJ (US)

(73) Assignee: Dialight Corporation, Farmingdale, NJ (US)

( * ) Notice: Subject to any disclaimer, the term of this patent is extended or adjusted under 35 U.S.C. 154(b) by 337 days.

(21) Appl. No.: 12/198,673

(22) Filed: Aug. 26, 2008

(65) Prior Publication Data

US 2009/0080193 A1 Mar. 26, 2009

Related U.S. Application Data

(60) Provisional application No. 60/968,165, filed on Aug. 27, 2007.

(51) Int. Cl.
*F21V 21/00* (2006.01)

(52) U.S. Cl. ..... 362/249.02; 362/249.01; 362/253; 362/294; 362/373

(58) Field of Classification Search ..... 362/249.01–249.02, 294, 373, 227, 234, 253; 315/291
See application file for complete search history.

(56) References Cited

U.S. PATENT DOCUMENTS

| | | | | |
|---|---|---|---|---|
| 6,588,920 | B2 | 7/2003 | Agro | |
| 2005/0083692 | A1 | 4/2005 | Leen | |
| 2005/0225968 | A1 | 10/2005 | Hatherill et al. | |
| 2006/0002110 | A1 * | 1/2006 | Dowling et al. | 362/252 |
| 2007/0121328 | A1 * | 5/2007 | Mondloch et al. | 362/294 |

OTHER PUBLICATIONS

PCT Search Report and Written Opinion for PCT/US 08/74347, Nov. 13, 2008, consists of 8 pages.

* cited by examiner

*Primary Examiner* — Stephen F Husar
*Assistant Examiner* — Meghan K Dunwiddie

(57) ABSTRACT

The present invention relates generally to a lighting apparatus for hazardous locations. In one embodiment, the lighting apparatus comprises a light engine, a heat sink coupled to the light engine, a stalk coupled to the light engine for externally coupling a power supply to the light engine and an electrical wiring splice box coupled to the stalk.

6 Claims, 8 Drawing Sheets

LED BASED HAZARDOUS LOCATION LIGHT WITH VERSATILE MOUNTING CONFIGURATIONS

RELATED APPLICATIONS

This application claims priority under 35 U.S.C. §119(e) to U.S. provisional patent application Ser. No. 60/968,165, filed on Aug. 27, 2007, which is hereby incorporated by reference in its entirety.

FIELD OF THE INVENTION

The present invention relates generally to a LED hazardous location light with versatile mounting configurations.

BACKGROUND OF THE INVENTION

Hazardous locations in various industries, categorized by various class and division require different types of lighting. Moreover, the lighting is required in various locations within the hazardous location itself. Currently, multiple different types of light are required based on where lighting is required. Thus, an enormous amount of resources may be expended on proper lighting in hazardous locations.

SUMMARY OF THE INVENTION

The present invention relates generally to a lighting apparatus for hazardous locations. In one embodiment, the lighting apparatus comprises a light engine, a heat sink coupled to the light engine, a stalk coupled to the light engine for externally coupling a power supply to the light engine and an electrical wiring splice box coupled to the stalk.

In one embodiment, the present invention provides a lighting apparatus comprising a light engine and a power supply that provides power to said light engine such that heat generated by said power supply is isolated away from said light engine.

In one embodiment, the present invention provides a method for providing a lighting apparatus. The method comprises providing a light engine and providing a power supply to said light engine, wherein said power supply is located externally to said light engine and heat generated by said power supply is isolated from said light engine.

BRIEF DESCRIPTION OF THE DRAWINGS

So that the manner in which the above recited features of the present invention can be understood in detail, a more particular description of the invention may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

To facilitate understanding, identical reference numerals have been used, where possible, to designate identical elements that are common to the figures.

DETAILED DESCRIPTION

The present invention provides a light emitting diode (LED) lighting apparatus 100 with versatile mounting configurations to address the above mentioned need. In one embodiment, the LED lighting apparatus 100 may be a LED hazardous location light. The modular mechanical design of the LED lighting apparatus 100 separates the power supply from light engine by use of a coupling stalk.

As a result, multiple advantages are provided. First, it makes thermal management of a LED light engine easier to achieve by locating heat generated by a power supply away from the LED light engine. Second, it allows the LED light engine to be mounted directly to a heat sink. Third, it allows the power supply to be remotely located if desired.

Figure 1:
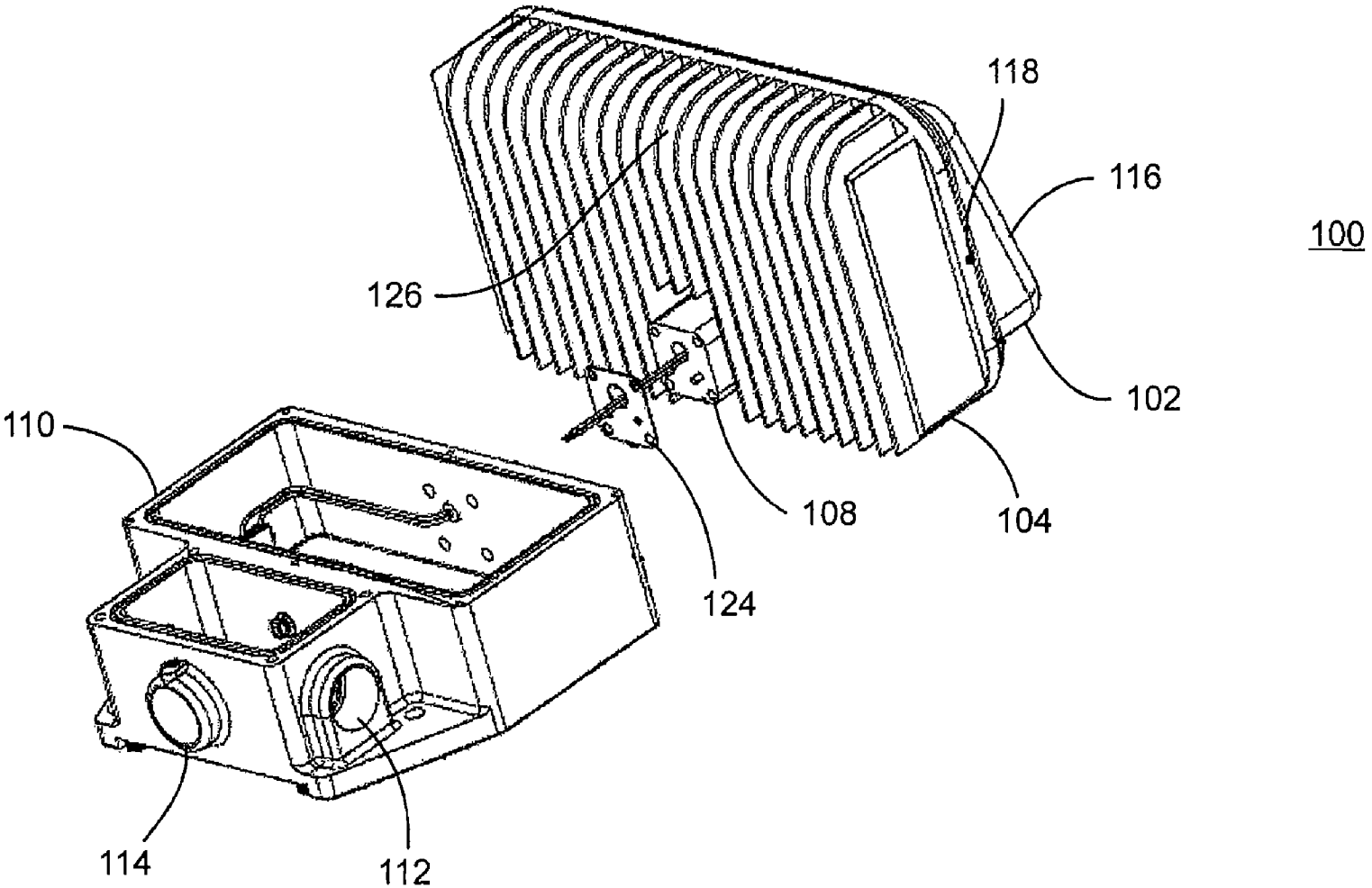
FIG. 1 illustrates an exploded view of a lighting apparatus of the present invention.

An exploded view of an exemplary LED lighting apparatus 100 is illustrated in FIG. 1. In one embodiment, the LED lighting apparatus 100 comprises an LED light engine 102, coupled to a heat sink 104. The LED light engine 102 may also be separated from a power supply (not shown) and an electrical wiring splice box 110. In the embodiment shown in FIG. 1, the electrical wiring splice box 110 may be separated from the power supply. That is, the power supply may be located remotely from the LED lighting apparatus 100. This keeps a factory seal of the power supply and ensures that no damage occurs to the power supply during field wiring. In another embodiment, the power supply may be located in the electrical wiring splice box 110.

The LED light engine 102 and the electrical wiring splice box 110 are coupled together by a coupling stalk 108. The coupling stalk 108 can be used to vary a distance or angle between the LED light engine 102 and the electrical wiring splice box 110. The coupling stalk 108 can have a standard pipe threading in order to adapt to other housings.

In the embodiment shown in FIG. 1, the electrical wiring splice box 110 compartment has one or more holes 112 and one or more holes 114 for attaching and/or wiring to threaded pipe. There may be one or more covers on both a front side and a back side of the splice box 110 to allow easy access in the field for a variety of different mounting arrangements.

Figure 2:
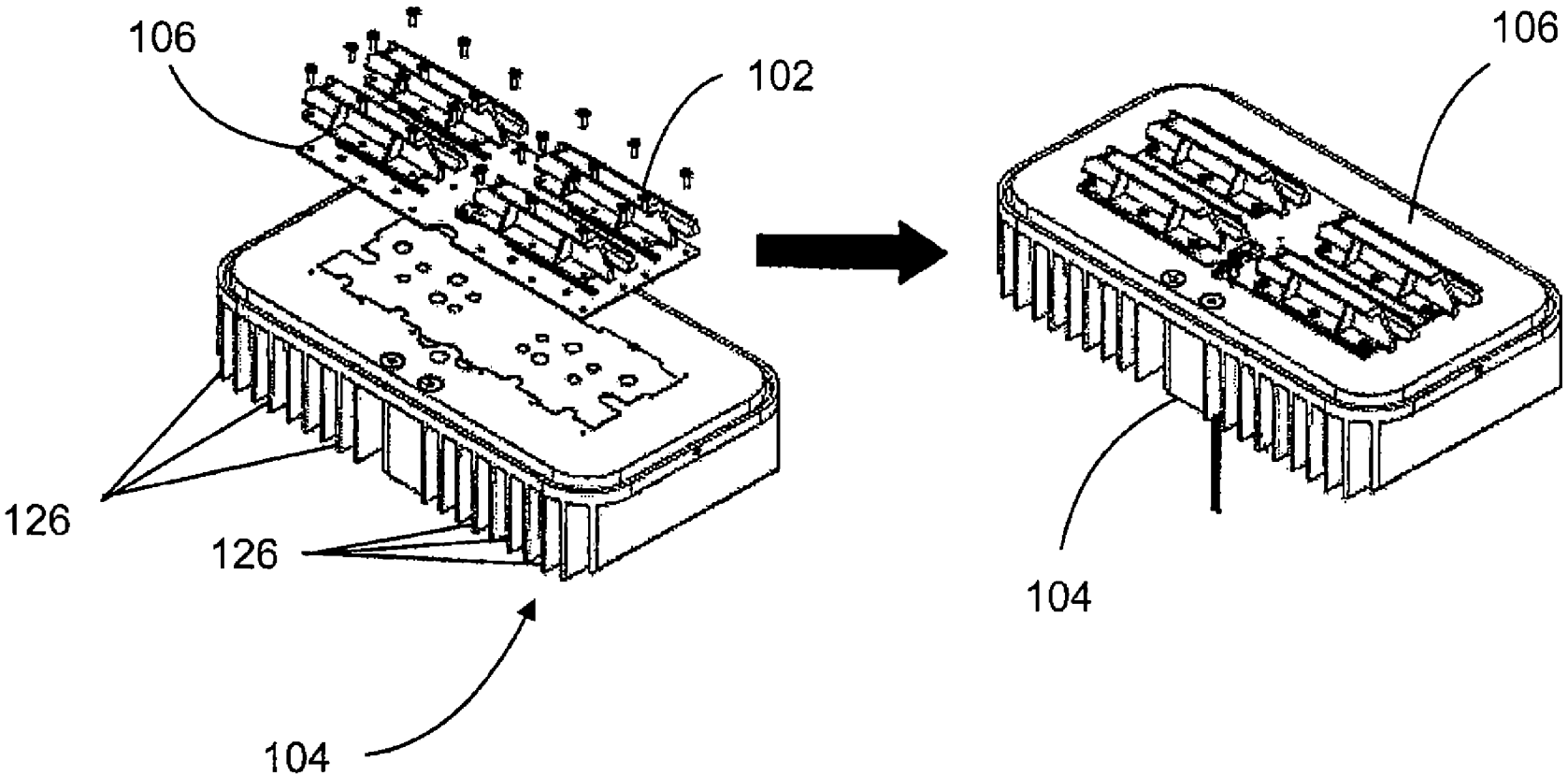
FIG. 2 illustrates an exploded view and assembled view of an exemplary light engine and heat sink of the present invention.

A high level block diagram of an illustrative embodiment of the LED light engine 102 and the heat sink 104 of an LED lighting apparatus 100 is illustrated in FIG. 2. FIG. 2 illustrates an exploded view and assembled view of the LED light engine 102, comprising a circuit board 106 having one or more reflectors and one or more LEDs, and the heat sink 104. The circuit board 106 may be coupled directly onto the heat sink 104 as illustrated by FIG. 2.

The heat sink 104 can be made using an extrusion tool. This allows for the use of a high-purity and defect-free thermally conductive metal such as aluminum, for example. The extrusion process enables the use of one or more heat sink fins 126. In one embodiment, the heat sink fins 126 are designed to be long and thin to maximize surface area. Mounting features can be machined into the heat sink 104 for the coupling stalk 108, a lens cover 116 or other component.

Referring back to FIG. 1, the coupling stalk 108 provides rigid support between the LED light engine 102 and electrical wiring splice box 110. The coupling stalk 108 may have pins, notches, keys, or other alignment features to ensure proper alignment between the LED light engine 102 and electrical wiring splice box 110. The coupling stalk 108 also protects one or more cables that connect the electrical wiring splice box 110 and the LED light engine 102. In one embodiment, the coupling stalk 108 is sealed to the electrical wiring splice box 110 and the LED light engine 102 using screws. The coupling stalk 108 can be a separate component that is screwed to both the electrical wiring splice box 110 and the LED light engine 102. This allows the LED light engine 102 to be replaceable in the field.

In another embodiment, the coupling stalk 108 is part of the electrical wiring splice box 110. In this case, only the LED light engine 102 needs to be fastened as a secondary operation. Long screws can be passed from the electrical wiring splice box 110 through the coupling stalk 108 and into the LED light engine 102. In a further embodiment, the coupling stalk 108 can be of a goose neck type and bend in one or more directions while still providing support between the LED light engine 102 and the electrical wiring splice box 110.

In another embodiment (not shown), the coupling stalk 108 is a standard 0.5 to 3.0 inch pipe fitting. In this case, the electrical wiring splice box 110 and LED light engine 102 can be screwed together allowing for easy replacement of the electrical wiring splice box 110 or LED light engine 102 in the field.

The coupling stalk 108 can have a seal 124 when connected to the electrical wiring splice box 110 and the LED light engine 102. The seal can be made using glue or a gasket. In one embodiment, the gasket materials can include silicone, neoprene, soft metal, or other elastomer. For example gaskets can be made of an o-ring shape or a flat compression type In one embodiment, the electrical wiring splice box 110 is mounted above the LED light engine 102. Air can pass between the LED light engine 102 and the electrical wiring splice box 110. This maximizes the outer surface area used for cooling and facilitates cooling of the electrical wiring splice box 110 and the LED light engine 102 by allowing air to pass between them. Mounting the electrical wiring splice box 110 above the LED light engine 102 results in a light fixture that has a very low profile to a wall. This is advantageous in many applications where equipment is moving through narrow passages.

In one embodiment, the electrical wiring splice box 110 and the LED light engine 102 are mounted at about 90 degrees to each other. This allows the electrical wiring splice box 110 to be wall-mounted and allows the LED on the LED light engine 102 to face directly toward the floor or other target illumination area.

Set screws 118 are used on the sides of the LED light engine 102 to hold a lens cover 116 in place while the bonding epoxy sets up. This makes manufacturing easier by eliminating the need for fixturing to hold the lens cover 116 in place while the epoxy hardens.

In one embodiment, the lens cover 116 may be tilted. The tilted front surface of the lens cover 116 changes the critical angle formed by the one or more reflectors and the front surface of the lens cover 116 so that more light can be projected at a greater distance from the LED light engine 102.

One or more holes 112 on both sides of the electrical wiring splice box 110 allow an in conduit and/or an out conduit for wall mounting. One or more holes 114 on the electrical wiring splice box 110 allow the LED lighting apparatus 100 to be pendant mounted. Furthermore, two LED lighting apparatuses 100 can be mounted back to back by bolting them together in order to create a circular light pattern, as discussed below. In one embodiment, the one or more holes 112 and 114 of the electrical wiring splice box 110 are between 0.5 and 2 inches in diameter. However, those skilled in the art will recognize that the one or more holes 112 and 114 may have a diameter of any dimension to accommodate necessary design parameters.

Figure 3:
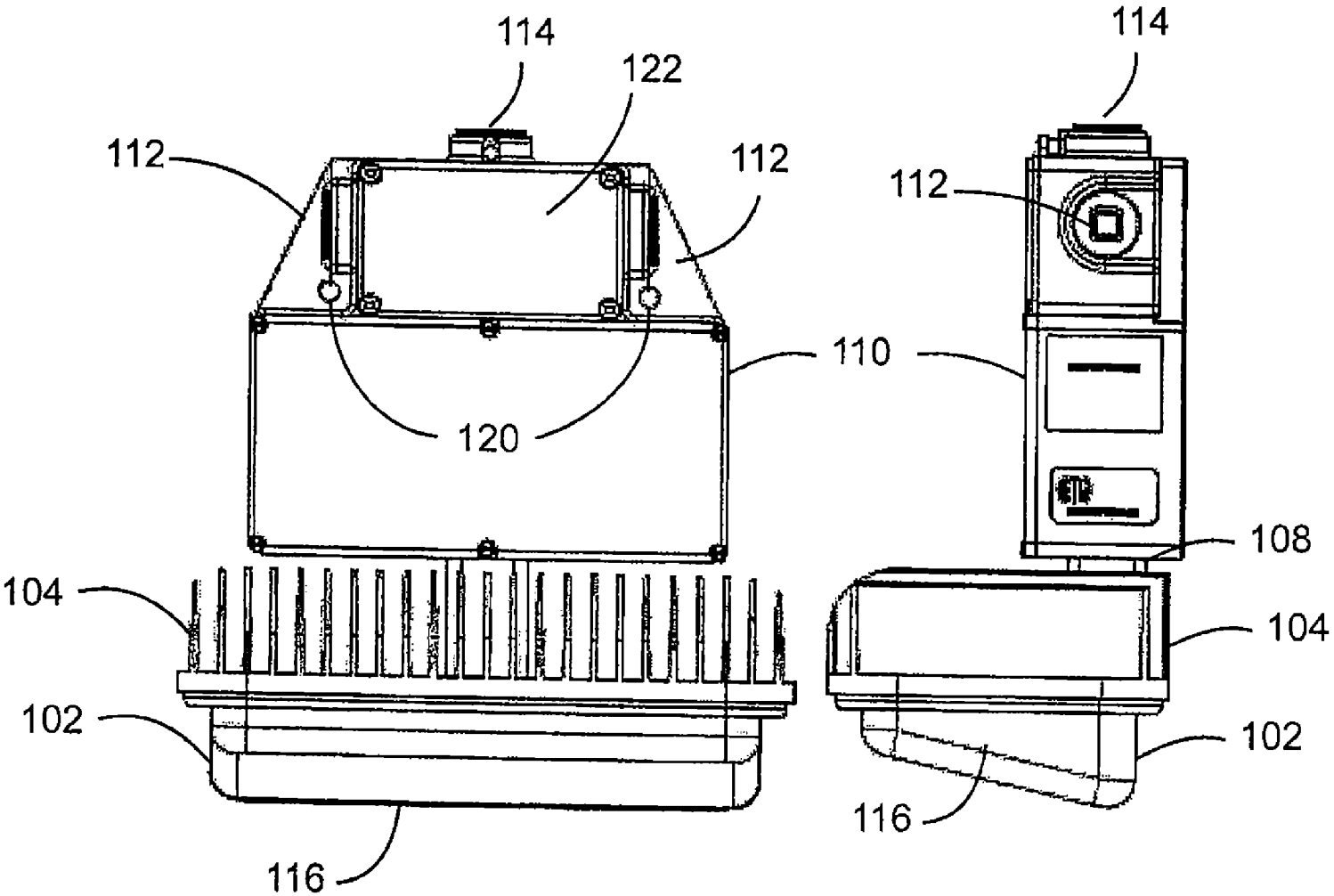
FIG. 3 illustrates a side and back view of a lighting apparatus of the present invention.

The overall design of the LED lighting apparatus 100 allows additional mounting configurations. The modular mechanical design and positioning of the electrical wiring splice box 110 and double covers allows flexibility in mounting configurations. A side and back view of the LED lighting apparatus 100 is illustrated in FIG. 3.

The LED lighting apparatus 100 may comprise one or more back plates 122. The back plate 122 provides design flexibility. As discussed below with reference to FIGS. 4-8, the back plate 122 is designed to receive various brackets that may be used for various types of mounting of the LED lighting apparatus 100.

The LED lighting apparatus 100 may also comprise one or more holes 120. The one or more holes 120 may be used for wall-mounting, as described above.

Figure 4:
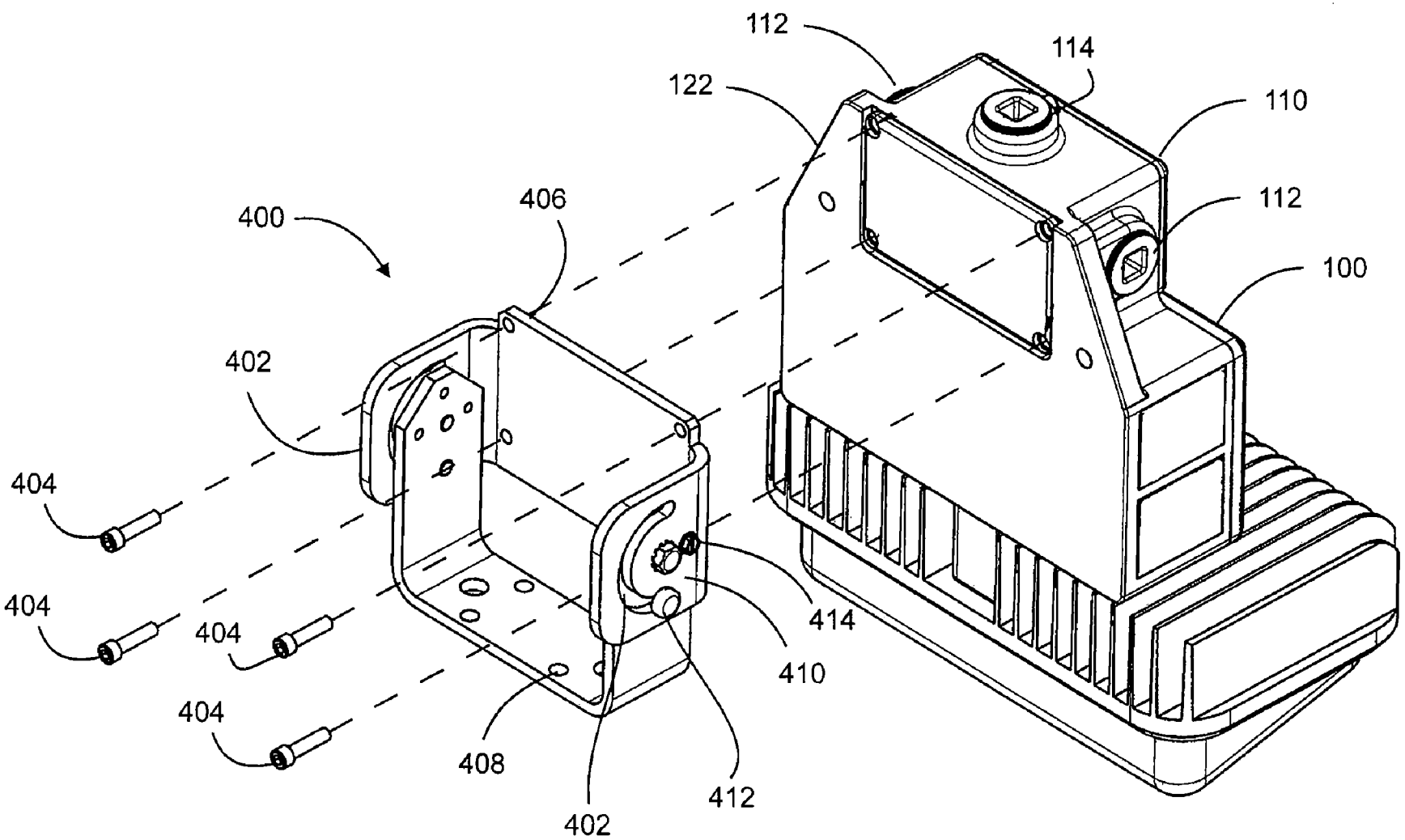
FIG. 4 illustrates one embodiment of a swing bracket.

In another embodiment illustrated in FIG. 4, a swing bracket 400 may be coupled to the back plate 122 of the LED lighting apparatus 100 by screws 404 for allowing various orientations of the LED lighting apparatus 100. In one embodiment, the swing bracket 400 comprises a fixed member 406 and a swinging member 408. The fixed member 406 may be coupled to the back plate 122 of the LED lighting apparatus 100 as discussed above.

The swinging member 408 may be coupled to the fixed member 406 via opposing hinges 402. The hinges 402 allow the swinging member 408 to move in various positions along the hinges 402. The hinges 402 may comprise a pivot bolt 410, a swing locking bolt 412 and a locking pin 414. The swing locking bolt 412 and the locking pin 414 allow the swinging member 408 to be locked in any position along the hinges 402. In other words, the locking pin 414 may be used to fix a bracket angle. This also reduces stress on the swing locking bolt 412. When using the swing bracket 400, the electrical connection can be made through the one or more holes 112 and 114 of the electrical wiring splice box 110 using a cord grip connector.

As a result, the LED lighting apparatus 100 may be positioned in various orientations. FIG. 4 illustrates the swinging member 408 in a down position. However, the swinging member 408 may be moved along the hinges 402 to a horizontal direction, an up direction or any direction in between along the hinges 402. As a result the LED light engine 102 of the LED lighting apparatus 100 may be allowed to tilt in various directions as desired.

Figure 5:
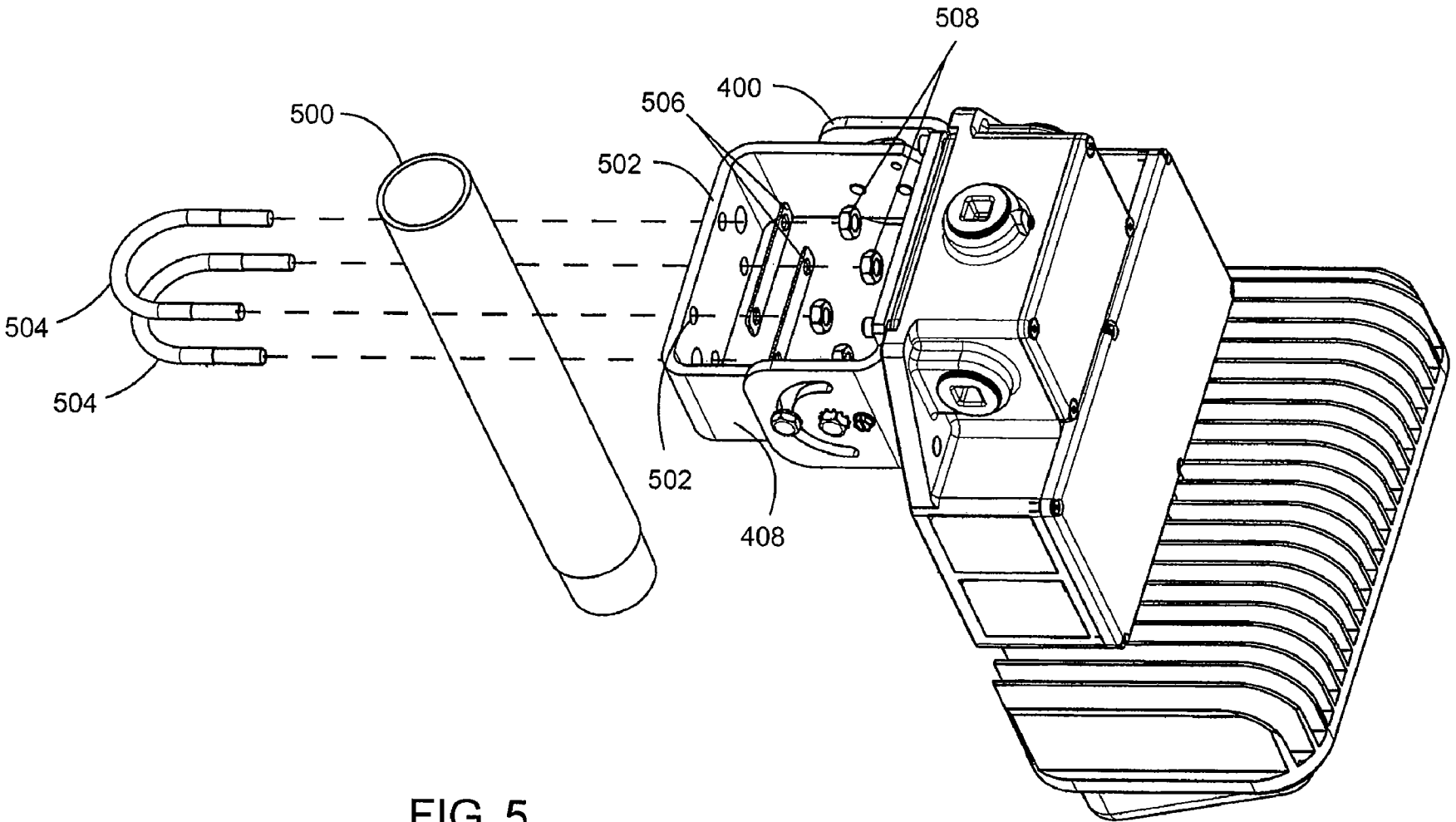
FIG. 5 illustrates one embodiment of the swing bracket used to mount the lighting apparatus to a pipe.

In one embodiment, the swing bracket 400 may be used to mount the LED lighting apparatus 100 to a pipe or pole 500 as illustrated by FIG. 5. The swinging member 408 may be moved to a horizontal position to receive one or more U-bolts 504. The U-bolts 504 may secure the LED lighting apparatus 100 to the pipe 500. The U-bolts 504 may be secured to the swinging member 408 through one or more holes 502 with one or more back plates 506 and one or more hex nuts 508. However, one skilled in the art will recognize that any means for fastening the U-bolts 504 to the swinging member 408 may be used.

Figure 6:
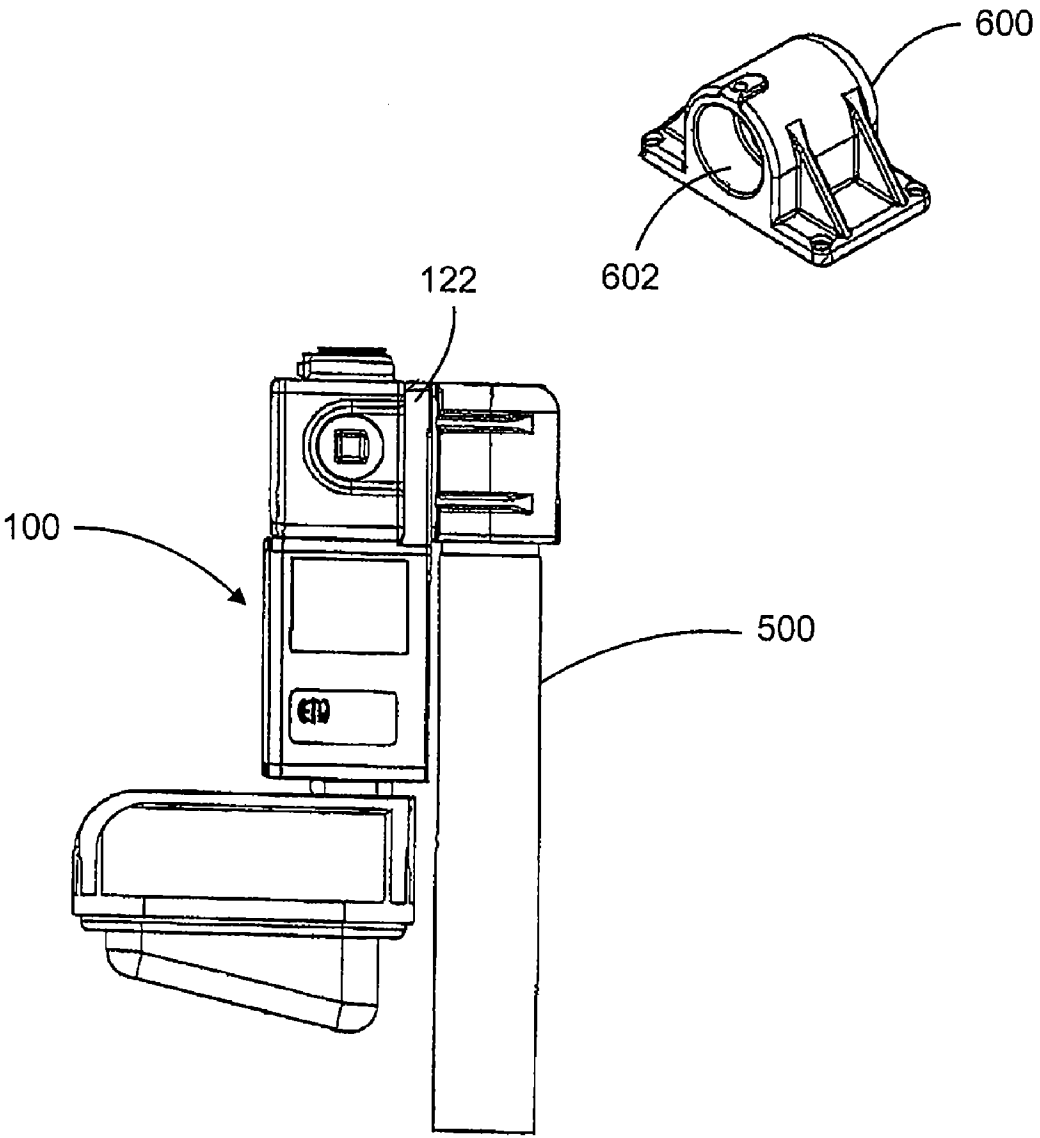
FIG. 6 illustrates one embodiment of a stanchion mount.

In another embodiment, a stanchion mount 600 may be used to mount the LED lighting apparatus 100 to the pipe or pole 500, as illustrated by FIG. 6. The stanchion mount 600 may be coupled to the back plate 122 of the LED lighting apparatus 100. Those skilled in the art will recognize that the stanchion mount 600 may be fabricated to fit any size diameter of the pipe 500. In one embodiment, a hole 602 of the stanchion mount 600 may be threaded for receiving the pipe 500. The hole 602 of the stanchion mount 600 may be between 0.5 and 3 inches diameter. A set screw can be used to lock the stanchion mount 600 to the pipe or pole 500.

Figure 7:
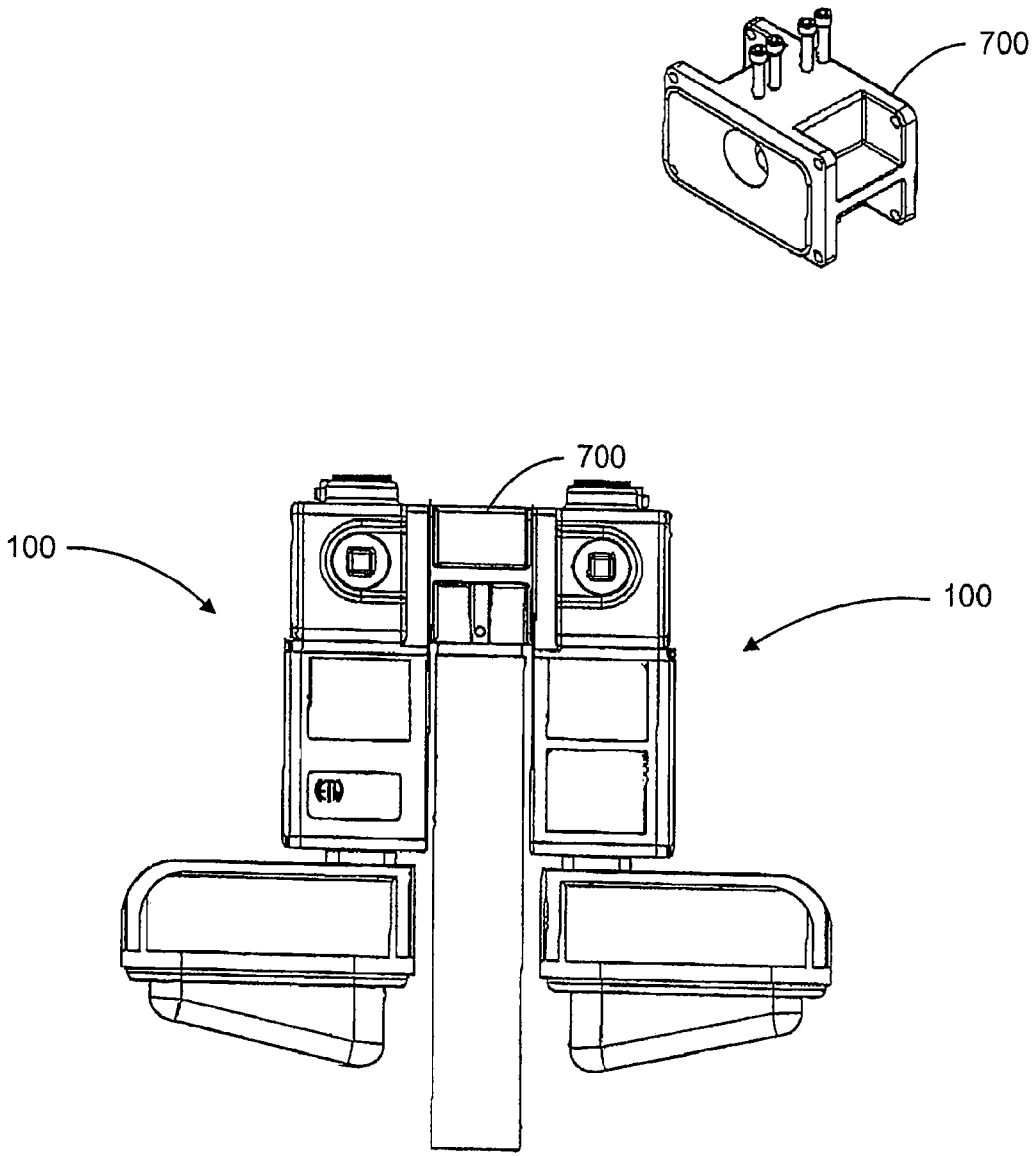
FIG. 7 illustrates one embodiment of a dual mount.

In another embodiment, two LED hazardous location lights 100 can be mounted back-to-back to increase the light output, as illustrated by FIG. 7. A dual mount bracket 700 can be used to mount the two LED lighting apparatuses 100 together. The dual mount bracket 700 separates the two LED lighting apparatuses 100 and again facilitates cooling by providing maximum surface area and increased air flow.

Figure 8:
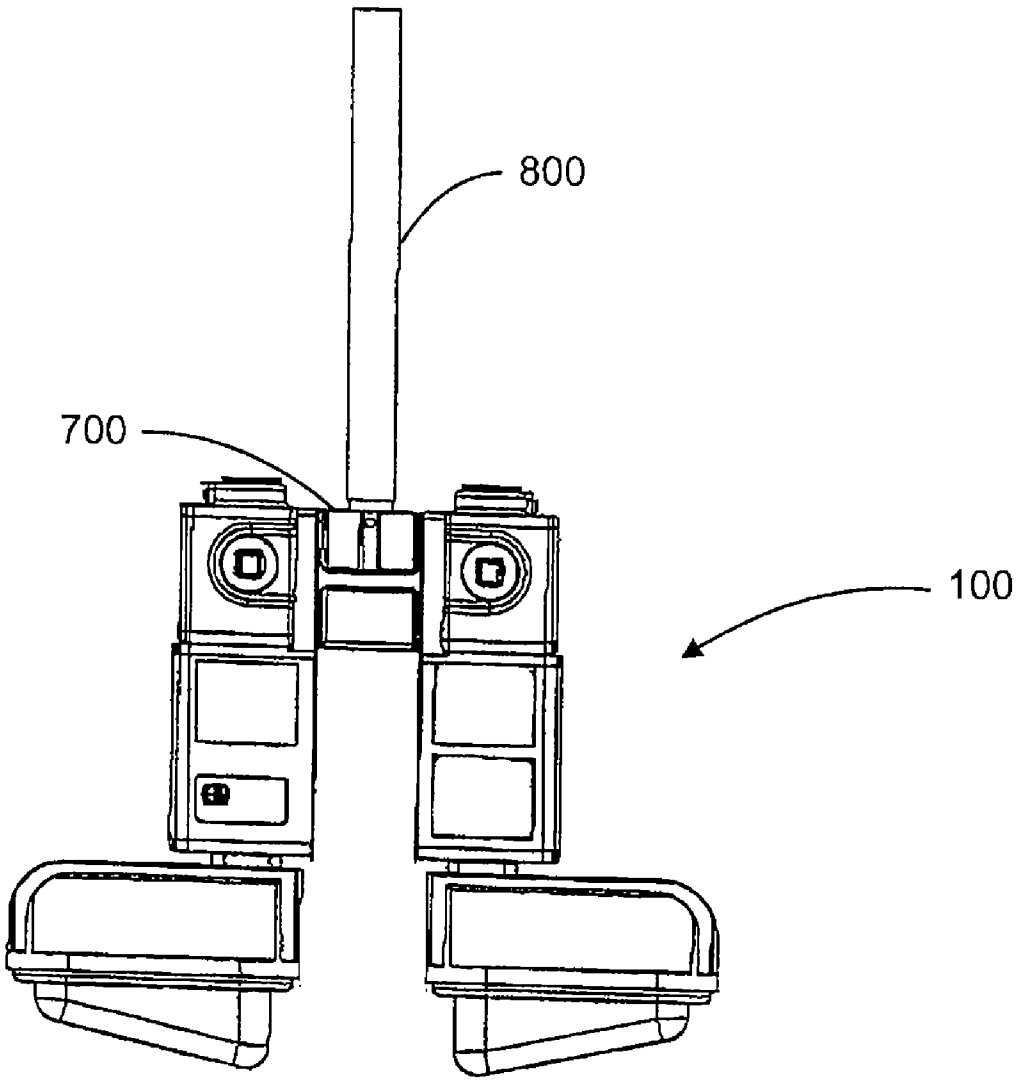
FIG. 8 illustrates one embodiment of a dual pendent mount.

In another embodiment, the dual mount bracket 700 allows two back-to-back LED lighting apparatuses 100 to be supported by a pole 800 from below or above, as illustrated in FIG. 8. The pole 800 may be coupled to the dual mount bracket 700 to allow a dual pendent mounting configuration. In a further embodiment, three or more LED light apparatuses 100 can be mounted in a radial pattern using a multi-position mount bracket instead of the dual mount bracket 700. The multi-position mount bracket would have extension arms so that the lights would be separated sufficiently. In this case, the units could all be mounted to the splice box.

While various embodiments have been described above, it should be understood that they have been presented by way of example only, and not limitation. Thus, the breadth and scope of a preferred embodiment should not be limited by any of the above-described exemplary embodiments, but should be defined only in accordance with the following claims and their equivalents.

What is claimed is:

1. A lighting apparatus, comprising:

a light engine comprising one or more light emitting diodes (LEDs);

a heat sink coupled to said light engine;

a stalk coupled to said light engine for externally coupling a power supply to said light engine; and an electrical wiring splice box coupled to said stalk, wherein said electrical wiring splice box comprises a back plate, wherein said back plate is configured for mounting said lighting apparatus to a second lighting apparatus in a back to back configuration.

2. A lighting apparatus, comprising:

a light engine comprising one or more light emitting diodes (LEDs);

a heat sink coupled to said light engine;

a stalk coupled to said light engine for externally coupling a power supply to said light engine; and an electrical wiring splice box coupled to said stalk, wherein said electrical wiring splice box comprises a plurality of holes, wherein said holes are configured for in and out conduits for wall mounting.

3. A lighting apparatus, comprising:

a light engine comprising one or more light emitting diodes (LEDs);

a heat sink coupled to said light engine;

a stalk coupled to said light engine for externally coupling a power supply to said light engine; and an electrical wiring splice box coupled to said stalk, wherein said electrical wiring splice box comprises a plurality of holes, wherein said holes are configured for pendant mounting.

4. A lighting apparatus, comprising:

a light engine; and a power supply that provides power to said light engine such that heat generated by said power supply is isolated away from said light engine, wherein an electrical wiring splice box comprises a back plate, wherein said back plate is configured for mounting said lighting apparatus to a second lighting apparatus in a back to back configuration.

5. A lighting apparatus, comprising:

a light engine; and a power supply that provides power to said light engine such that heat generated by said power supply is isolated away from said light engine, wherein an electrical wiring splice box comprises a plurality of holes, wherein said holes are configured for in and out conduits for wall mounting.

6. A lighting apparatus, comprising:

a light engine; and a power supply that provides power to said light engine such that heat generated by said power supply is isolated away from said light engine, wherein an electrical wiring splice box comprises a plurality of holes, wherein said holes are configured for pendant mounting.

* * * * *